United States Patent [19]

Inacker et al.

[11] Patent Number: 4,586,047

[45] Date of Patent: Apr. 29, 1986

[54] EXTENDED BANDWIDTH SWITCHED ELEMENT PHASE SHIFTER HAVING REDUCED PHASE ERROR OVER BANDWIDTH

[75] Inventors: Henry F. Inacker, Cinnaminson; Larry L. Humphrey, Mount Laurel; David Staiman, Cinnaminson, all of N.J.

[73] Assignee: RCA Corporation, Princeton, N.J.

[21] Appl. No.: 509,039

[22] Filed: Jun. 29, 1983

[51] Int. Cl.[4] ..... H01Q 3/38

[52] U.S. Cl. ..... 343/372; 343/377; 333/156; 333/164

[58] Field of Search ..... 333/164, 157, 156; 343/372, 371, 377, 368, 373, 16 R, 16 LS; 307/362; 328/55, 155

[56] References Cited

U.S. PATENT DOCUMENTS

| | | | |
|---|---|---|---|
| 3,182,324 | 5/1965 | Nelson et al. | 343/368 |
| 3,501,764 | 3/1970 | Mailloux et al. | 343/373 |
| 3,611,401 | 10/1971 | Connolly | 343/372 X |
| 3,697,994 | 10/1972 | O'Daniel | 343/372 X |
| 3,699,584 | 10/1972 | Hrivnak et al. | 328/155 X |
| 4,034,374 | 7/1977 | Kruger | 343/372 X |
| 4,090,199 | 5/1978 | Archer | 343/377 X |
| 4,259,670 | 3/1981 | Schiavone | 343/700 MS |
| 4,270,104 | 5/1981 | Schwarzmann | 333/28 R |
| 4,308,539 | 12/1981 | Birch | 343/368 |
| 4,320,401 | 3/1982 | Schiavone | 343/700 MS |
| 4,348,676 | 9/1982 | Tom | 343/16 M X |

*Primary Examiner*—Eugene R. LaRoche
*Assistant Examiner*—Benny T. Lee
*Attorney, Agent, or Firm*—Joseph S. Tripoli; Robert L. Troike; Robert Ochis

[57] ABSTRACT

Switched line phase shifters are provided with an increased operating frequency range for a given level of phase setting accuracy by providing increased-resolution phase shifters and by translating phase commands in accordance with the center frequency of the signal to be phase shifted.

13 Claims, 5 Drawing Figures

EXTENDED BANDWIDTH SWITCHED ELEMENT PHASE SHIFTER HAVING REDUCED PHASE ERROR OVER BANDWIDTH

The present invention relates to phase shifters and more particularly to phase shifters for use over a wide bandwidth.

Many microwave systems employ switched line phase shifters because they are much lighter and are more compact than gyromagnetic phase shifters. Switched line phase shifters are found in frequency agile antenna array systems in which the pulsed or CW carrier signal changes frequency (hops) frequently for security or electronic counter-counter measures reasons. In such systems a relatively narrow bandwidth signal is switched around over a relatively wide range of frequencies within the bandwidth of the transmission system in use. A desired combination of increased phase accuracy and wider hopping frequency ranges have led to phase accuracy/bandwidth requirements which exceed the phase accuracy/bandwidth capabilities of prior art switched line phase shifters. This result is due, in part, to the fact that the switchable lines used in such phase shifters have phase lengths which increase with increasing frequency. Thus, increasing phase accuracy requirements cause limitations of the frequency range to narrower bandwidths and vice versa.

In many such sysems the use of gyromagnetic phase shifters (which can combine high accuracy and wide bandwidth) is not possible. Among the reasons are the high cost, large size and much greater weight of gyromagnetic phase shifters. Thus, there is a need for a switched line phase shifter combining increased phase accuracy with an increased operating bandwidth.

The present invention overcomes the phase accuracy/bandwidth limitations of prior art switched line phase shifters through use of increased-resolution phase shifters in combination with frequency dependent means for translating phase commands. In a preferred embodiment where a six-bit phase accuracy is required, a seven-bit phase shifter is used. The phase command translator receives both a six-bit phase command and a frequency selection signal and translates those signals into a seven-bit phase control signal for setting the phase shifter. This control signal sets the seven-bit phase shifter to a condition in which it provides the commanded phase shift with the required 6-bit accuracy at the selected frequency. The phase command translator may be a read only memory which is addressed by the received control signals and whose output is the phase control signal.

Figure 1:
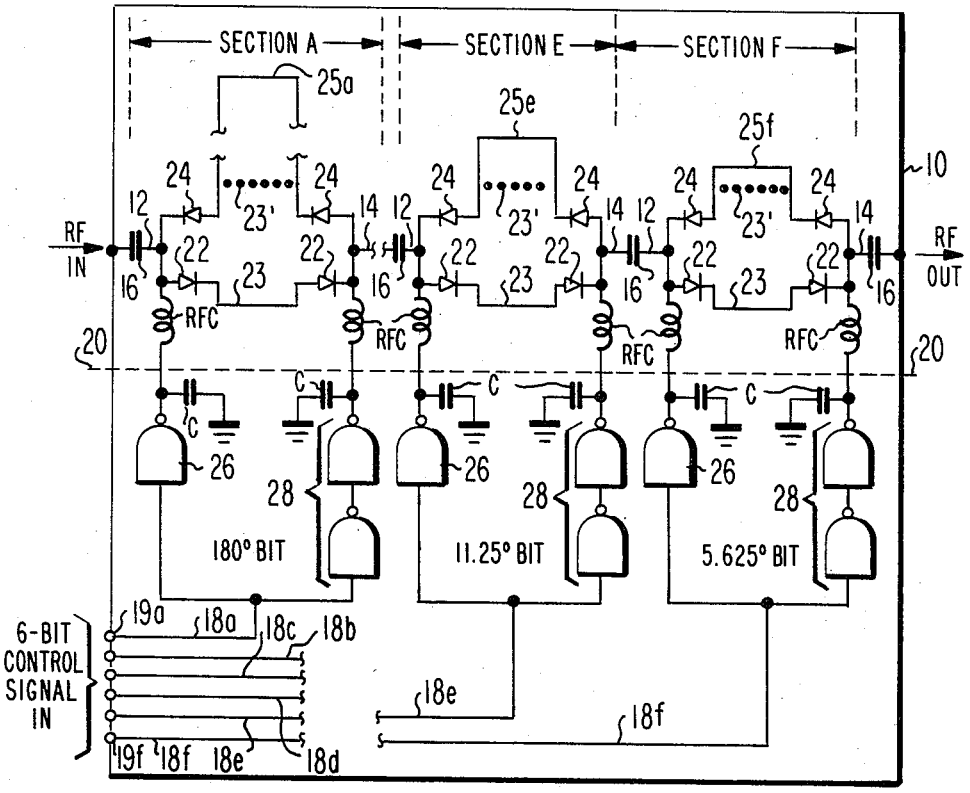
PRIOR ART Fig. 1
FIG. 1 illustrates a prior art 6-bit switched line phase shifter.

A prior art 6-bit phase shifter is shown at 10 in FIG. 1. This phase shifter has six separate switched-line phase shift sections A, B, C, D, E and F connected in series. When set, these sections introduce phase shifts of 180°, 90°, 45°, 22.5°, 11.25° and 5.625°, respectively, at a single reference frequency. Sections B, C, and D (90°, 45° and 22.5°) have been omitted from the drawing for clarity. A phase shifter when inserted in a circuit and set to 0° phase introduces an inherent minimum phase shift. This is referred to as the initial phase of the phase shifter. The initial phase is considered a part of the overall circuit in which the phase shifter is included. The phase shifter adjusts phases relative to that initial condition of the circuit. With digitally commanded phase shift systems a desired phase shift is "rounded" to the next closest available digital increment during the process of generating the phase command. For example when a phase shift of 93° is desired from the 6-bit phase shifter 10, the two closest available phase shift values are 90° and 95.625° for which the command signals are 010000 and 010001. The command signal 010001 is generated because 93° is closer to 95.625° than 90°.

The portion of the phase shifter 10 structure above the dashed line 20 in FIG. 1 is the RF portion of the circuit. Each section A–F, has an input line 12, an output line 14 and two alternate RF paths in parallel coupled between these lines. The upper RF path in each section comprises a relatively long transmission line 25 and two PIN switching diodes 24 in series (one at either end of the line 25). The diodes 24 are poled for DC current flow in the direction from the output line 14 to the input line 12. The relatively long line 25 is made to have a different electrical length in each section and is therefore denominated as line **24*a* in section A, as 25*b* in section B, and so forth through 25*f*** in section F. All of the other portions of each of the sections A–F are preferably identical.

A lower RF path in FIG. 1 comprises a relatively short line 23 and two PIN switching diodes 22 in series (one at either end of line 23) coupling it respectively to the section input line 12 and the section output line 14. The PIN diodes 22 are poled for DC current flow in the direction from input line 12 toward output line 14.

In each section A–F, the dotted line 23' marks the location for the horizontal portion of its line 25 at which line 25 would be the same electrical length as line 23. The differential phase shift introduced by each section A–F is proportional to the additional length of line 25 above dotted line 23'.

PIN diodes 22 and 24 exhibit high RF impedance when reversed biased and low RF impedance when forward biased. Applying a DC potential between the input line 12 and the output line 14 forward biases one set of diodes and reverse biases the other set. The RF current will follow the path in which the diodes are forward biased. The individual Sections A–F are DC isolated from each other by coupling capacitors 16 to prevent interaction among their DC diode biasing signals.

The portion of the FIG. 1 circuit below the dashed line 20 provides DC bias for controlling the state of the diodes 22 and 24 in response to an input control signal. RF chokes (RFC) and bypass capacitors (C) isolate the RF signal from the bias supply circuitry.

Each section A–F has its own associated control signal input bus comprising lines **18*a*–18*f*, respectively, which is externally accessible at a corresponding input terminal 19*a*–19*f*. In each section a DC bias voltage for the diodes 22 and 24 is provided by coupling the signal on its control signal line 18 to the RF input line 12 through an inverter 26 and to the RF output line 14 via a series 28 of two inverters. Thus, a low voltage on line 18 forward biases (low impedance) the diodes 22 and reverse biases (high impedance) the diodes 24. Under these conditions the RF current flows through the lower RF path 23. Application of a high voltage to the line 18 reverse biases diodes 22 and forward biases diodes 24. Under these conditions the RF current flows through the upper (longer) RF path 25. A six-bit control signal applied to the control lines 18***a*–18*f* will set the state of the RF phase shifter to a corresponding value which may be any value between 0° and 354.375° in increments of 5.625°. A phase shift of 0° is equivalent to one of 360°. Thus a full cycle of phase shift control is provided. A phase command signal which is appropriate for setting the phase shifter may be provided, inter alia, by the beam steering controller (BSC) in a phased array antenna system.

The phase shifter 10 is preferably fabricated as a microstrip transmission line system. The RF conductors illustrated in FIG. 1 are printed conductors on one surface of a ceramic substrate having a ground plane on its other surface. The DC bias signals may be applied in any appropriate manner such as by feed throughs from the back side of the substrate, by printed conductors on the front of the substrate or other techniques.

It is the nature of the microstrip transmission lines 25*a*–25*f* that their phase length increases with increasing frequency. Thus, when an RF signal having a frequency greater than $F_C$ is applied to the phase shifter, the phase shifts will actually be greater than called for by the phase control signal. In a similar manner, application of an RF signal having the frequency less than $F_C$ will produce phase shifts which are less than actually called for by the phase control signal. This is a well-known phenomena and in the past has been accommodated by design of phase shifters for particular operating frequencies. Thus, at the RF center frequency ($F_C$) for which the phase shifter is designed, the difference in phase length between each line 23 and the associated line 25*a*–25*f*, is made equal to the phase that section is to introduce when set. Thus the line 25*a* is 180° longer than line 23 at $F_C$.

Figure 2:
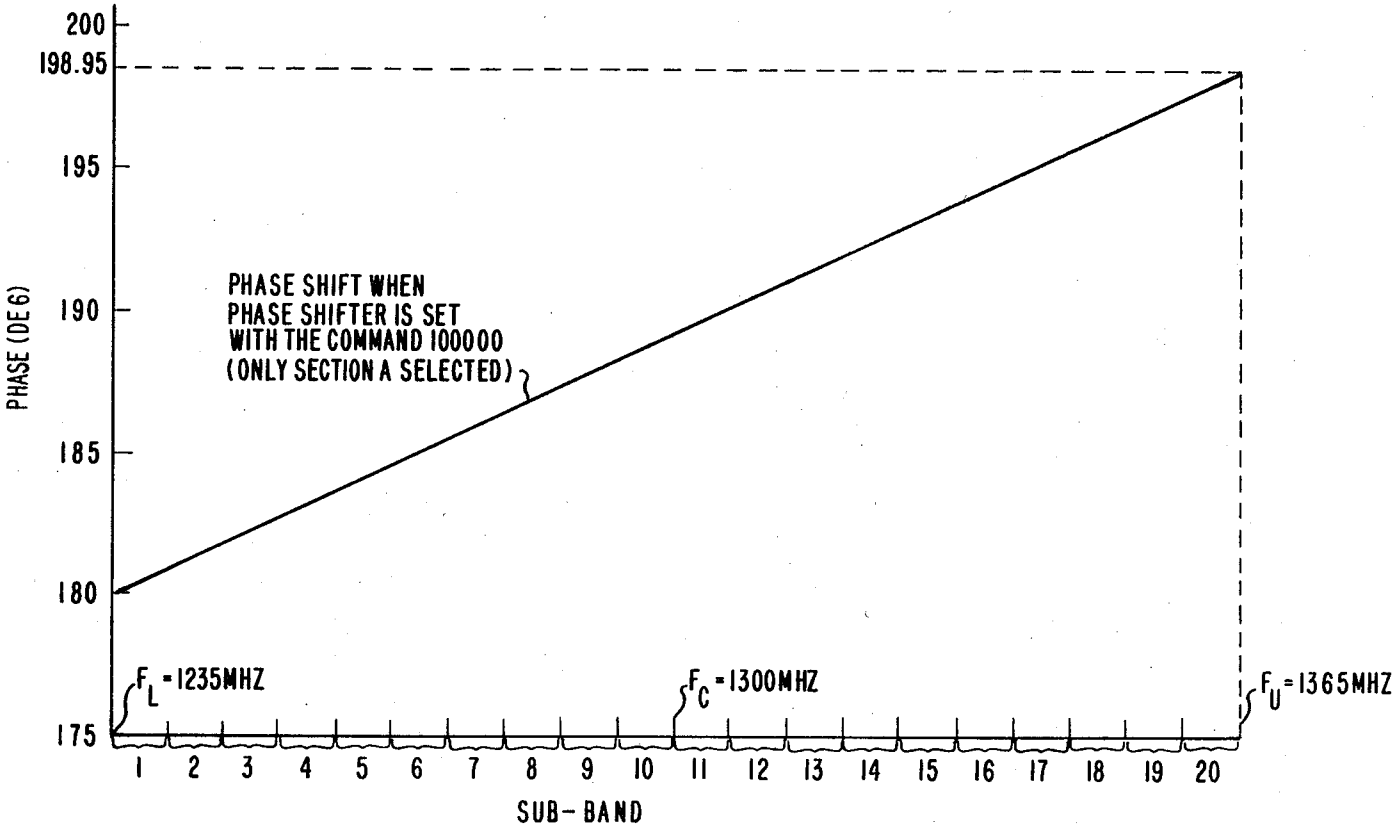
Fig. 2 PRIOR ART
FIG. 2 illustrates the phase variation of a prior art switched line phase shifter with frequency.

A phase shifter 10 having a center frequency $F_C$ of 1300 MHz has the phase versus frequency characteristics illustrated in FIG. 2 for a phase setting of 180°. At a desired lower limit operating frequency $F_L$ of 1235 MHz the phase is 180° and at a desired upper limit operating frequency $F_U$ of 1365 MHz the phase is 198.95°. These values correspond to phase errors of 0° at $F_L$ and 18.95° at $F_U$. The phase error at $F_L$ is zero degrees for each section whether selected or not. The Table lists the phase error at $F_U$ for each of the six sections of the phase shifter when it is selected. At $F_U$ for every section, the phase error will be zero in a first state (non-selected—a corresponding bit value of 0) and the value shown in the peak error column of the Table in the other (second) state (selected—a corresponding bit value of 1). Since each state (selected or non-selected) is equally likely, the root-mean-square (rms) phase error is as shown in the RMS error column and has a value of $1/\sqrt{2}$ times the corresponding peak error. The root-sum-square (rss) of the errors in each of the sections yields the net rms phase error for the phase shifter of 15.470°.

TABLE

| Section | Phase Shift when selected at $F_L$ | Phase Error in 6-Bit Phaser Not Including Quantization (Frequency = $F_U$): Actual Shift when selected at $F_U$ | Error at $F_U$ (Deg) | RMS Error (Deg) |
|---|---|---|---|---|
| A | 180 | 198.95 | 18.95 | 13.4 |
| B | 90 | 99.47 | 9.47 | 6.7 |
| C | 45 | 49.74 | 7.740 | 3.35 |
| D | 22.5 | 24.87 | 2.370 | 1.67 |
| E | 11.25 | 12.43 | 1.180 | 0.83 |
| F | 5.625 | 6.22 | 0.59 | .42 |
| | | | | RSS = 15.470° rms |

In prior art systems four or five bit phase shifters having granularities of 22.5° or 11.25°, respectively, usually provided acceptable system performance. Such phase shifters were useful over substantial bandwidths about their center frequency $F_C$. The need for increased phase accuracy which led to the use of six-bit phase shifters having granularities of 5.625° has shrunk the frequency range over which adequate phase accuracy is maintained by these prior art phase shifters. A need has also developed for systems having wider operating bandwidths. This need is in direct conflict with the need for greater accuracy, yet in many instances both needs are exhibited in the same system.

Figure 3:
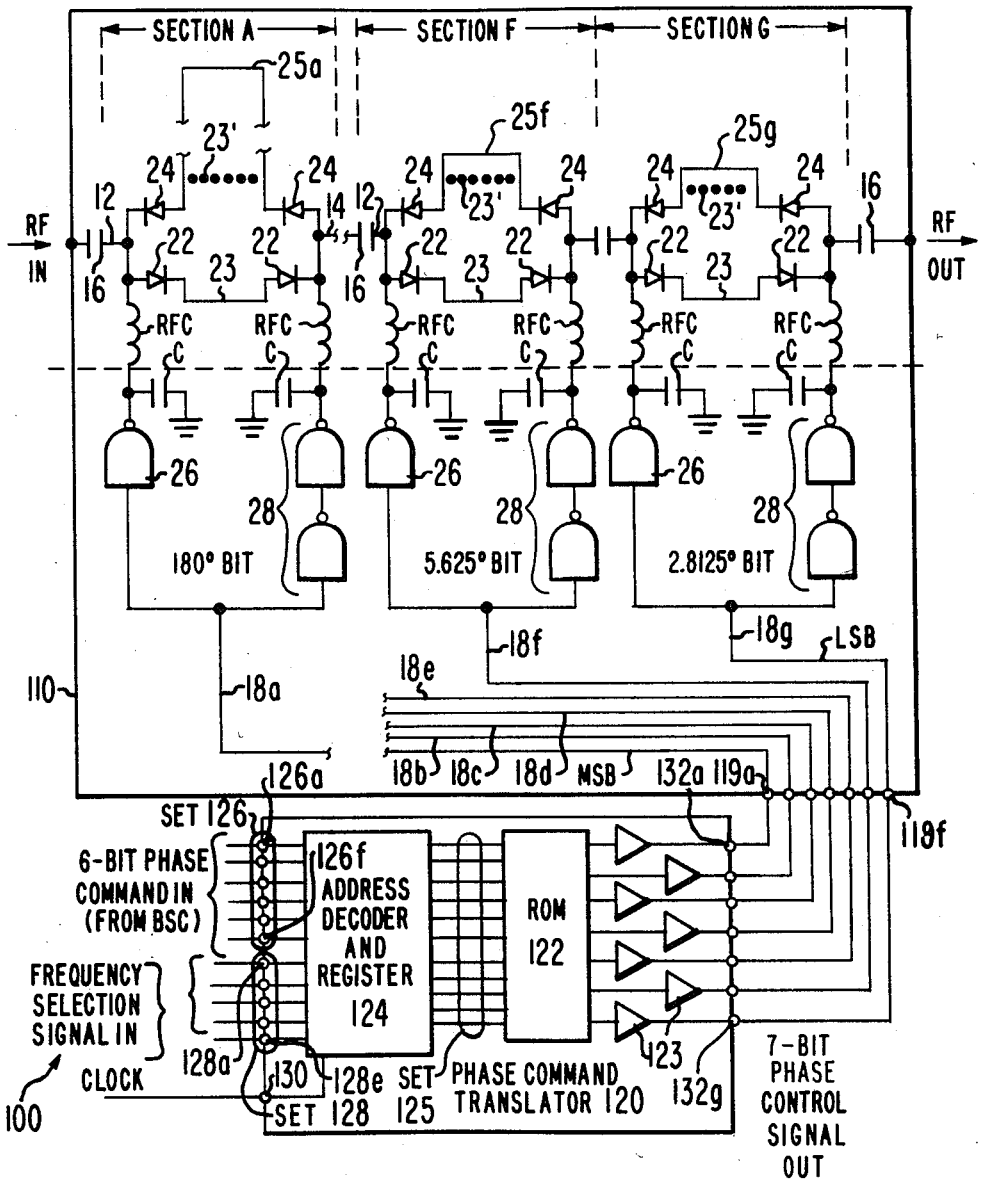
FIG. 3 illustrates a phase shifting system in accordance with the present invention.

FIG. 3 illustrates a phase shifter system 100 in accordance with this invention which extends the frequency range over which a desired degree of phase accuracy can be obtained. System 100 includes a seven-bit phase shifter 110 and a phase command signal translator 120. Phase shifter 110 may be identical to phase shifter 10 except for the addition of a seventh phase shifter section G which introduces a phase shift of 2.8125° when selected. Section G has a relatively long RF line 25*g*. Sections B–E (90°, 45°, 22.5°, 11.25°) are omitted from FIG. 3 for clarity.

Phase command translator 120 may comprise a read only memory (ROM) 122 and an address decoder and register 124 for the ROM. The phase command translator has a set of input terminals 126 for receiving phase command signals and a set of input terminals 128 for receiving a frequency selection signal. For direct substitution of the phase shifting system 100 for the phase shifter 10 of FIG. 1 there are six terminals 126*a*–126*f* for receiving a six-bit phase command signal. The number of terminals in set 128 depends on the required phase accuracy and the bandwidth over which the system is to operate. Five terminals 128*a*–128*e* are shown for receiving a five-bit frequency selection signal. The terminals 126 and 128 are coupled to the address decoder and register 124 which combines these signals and holds the decoded value in its register as the address within the ROM from which stored information will be read. The address output provided by address decoder and register 124 is coupled to the address input of ROM 122 by a set 125 of address lines. The value of this address may be formed by a direct combination of the six-bit phase command and the five-bit frequency selection signal to form an eleven-bit address signal. In this case, the address register within circuit 124 is eleven bits long. At any given time only one address value is provided by decoder and register 124. What information is stored in ROM 122 is discussed further on. A clock signal input terminal 130 provides for clock control of the ROM readout process. The output of ROM 122 may be amplified in amplifiers 123 if necessary to provide adequate drive. The ROM provides seven bits at its output which are provided at the output terminals 132 of the phase command translator 120 as a seven-bit phase control signal. This signal is coupled to the control signal input terminals 119*a*–119*g* of the phase shifter 110.

The frequency selection signal specifies the frequency band for which the phase shifter must provide a phase shift which has a six-bit accuracy. That is, since the desired phase shift is specified with a granularity of 5.625° by the six-bit phase command signal, then at any selected frequency within the operating frequency range of the phase shifter, the actual phase shift provided should be within 2.8125° (one half of 5.625°) of the specified phase shift. Thus, in FIG. 4, the six-bit input phase command signal 100000 specifies a phase setting of 180°. Through the use of the various seven-bit phase commands illustrated in FIG. 4 in the appropriate frequency sub-band the phase shift provided by the phase shifter in response to that six-bit phase command is held to within the 2.8125° of 180°. As illustrated by FIG. 2 and by the dashed line marked "uncorrected" in FIG. 4, the phase error across that operating frequency range would vary from 0° to 18.95° in the absence of translation of the phase commands. The accuracy of the phase shift depends on how broad a range a given frequency selection signal specifies. The narrower that frequency range, the more accurate the phase setting can be. However, for a given overall operating range $F_U$-$F_L$ shrinking the frequency bands increases the number of such bands and requires a ROM having a proportionately greater capacity.

The information which is stored in ROM 122 depends on the frequency ranges for which the phase shifter will be utilized and on the particular characteristics of the phase shifter. What information to store in ROM 122 for a given sub-band may be determined by applying the center frequency of that sub-band to the input terminal of phase shifter 110 and by measuring the relative phase at the output terminal. The phase shifter 110 is then set to each of its 128 possible phase settings in succession and the phase of the output is measured for each setting. The seven-bit phase control signal which produces the phase closest to each of the 64 phases which can be commanded by a six-bit phase command is recorded and stored in ROM 122 in the register which is addressed by the corresponding six-bit phase command in combination with the frequency selection signal for that frequency sub-band. This process is repeated for each of the frequency sub-bands. Once all of the seven-bit phase control signals which will be needed have been determined, they are stored in the ROM 122. The ROM 122 may have its storage controlled by mask level definition or it may be one of the wide variety of programmable ROMs. In that instance these seven-bit phase commands are programmed into the ROM after completion of ROM fabrication. Using modern printed circuit switched line phase shifter construction techniques, the phase shifting system 100, including the programmed ROM, may be mass produced for use in systems requiring a large number of phase shifters. Means other than ROM 122 may be used for translating the phase commands, if desired. These techniques include, inter alia, look-up table systems, calculational systems which calculate the translated value using a model of the phase shifter's frequency characteristics and the desired phase and frequency.

Figure 4:
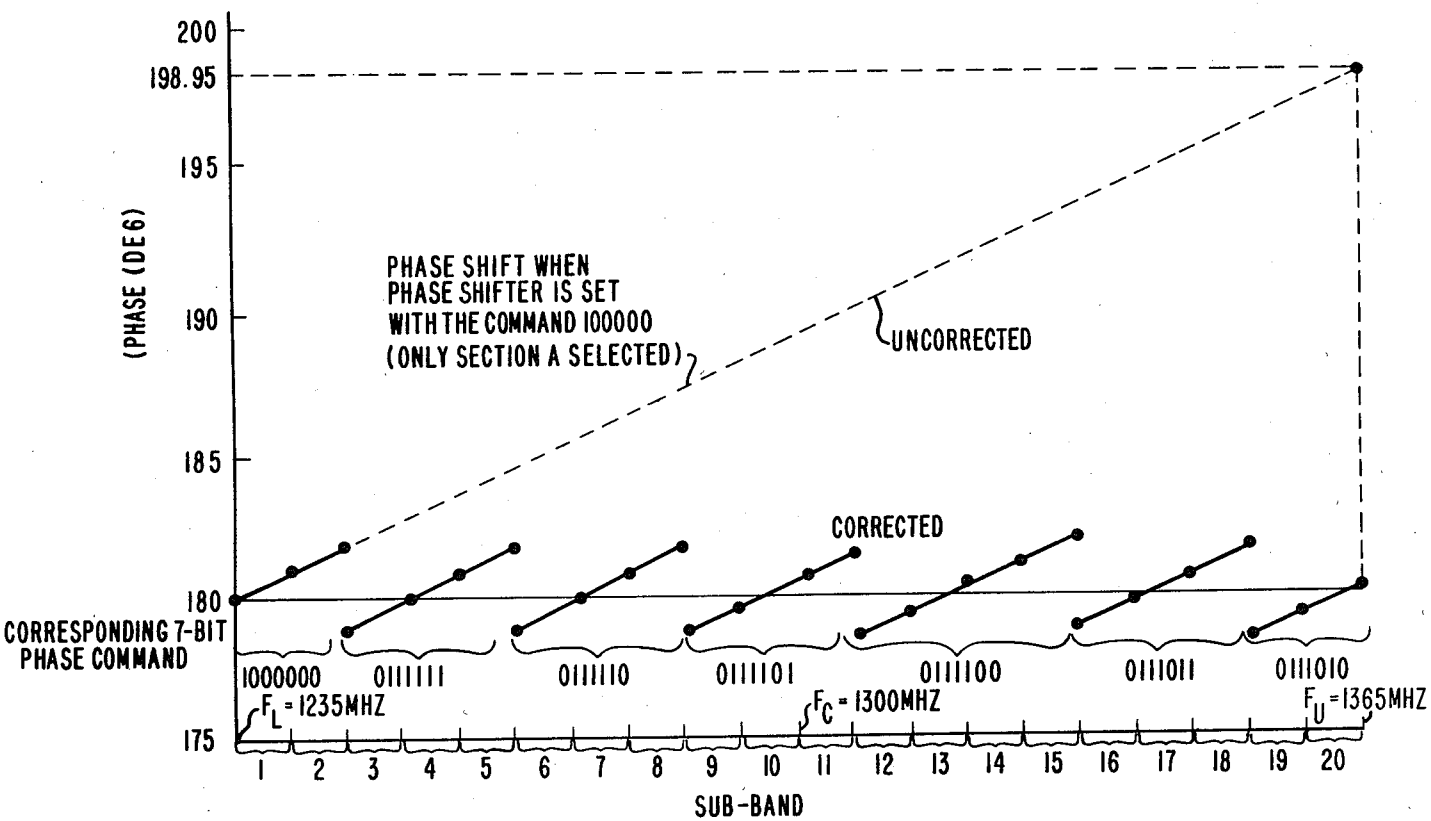
FIG. 4 illustrates the phase variation with frequency of the phase shifting system of FIG. 3.

FIG. 4 illustrates the manner in which the phase shifting system 100 maintains the phase shift with the required six-bit accuracy. This provides a piece-wise phase shift characteristic for the phase shifting system which meets the needs of systems which change the center frequency of a narrow band signal over a wide range of frequencies. The operating frequency band is divided into twenty sub-bands numbered from 1 to 20 in FIGS. 2 and 4. Seven different phase commands are used over the full twenty sub-band range to obtain an actual phase shift which is within a few degrees of the desired 180° phase shift. For a larger phase shift (such as 270°) a larger number (10) of different phase commands are needed. For a smaller phase shift (such as 45°) a smaller number (3) of different phase commands are needed.

Phase command translator 120 sets the phase control signal for each of the twenty sub-bands independently, although as seen from FIG. 4, the same phase control signal may be provided for a number of successive sub-bands for a given desired phase shift (180° in FIG. 4). Even for those sub-bands for which the same phase control signal value is provided, that value is the result of a different combination of input signals to the phase command translator 120 for each of those sub-bands. Thus, as shown in FIG. 4, the seven-bit phase control signal 1 000 000 is provided for both sub-band 1 and sub-band 2 when a phase shift of 180° is specified. However, the seven-bit control signal 1 000 000 for sub-band 1 is stored in the ROM register which is addressed by the six-bit phase command 100 000 (180°) in combination with the frequency selection signal for sub-band 1 which may, for example, be 00 000, which when combined create the eleven-bit address 10 000 000 000. The seven-bit phase control signal 1 000 000 for sub-band 2 is stored in a ROM register which is addressed by the six-bit phase command 100 000 and the frequency selection signal for sub-band 2 which may, for example, be 00 001, which when combined create the eleven-bit address 10 000 000 001. The number of sub-bands (twenty in this embodiment) may be selected on the basis of the number of sub-bands needed to provide a desired phase shift accuracy or may be determined by the number of different operating frequencies to be used. Thus, for a system which employs twenty different frequencies, twenty sub-bands each centered at one of the operating frequencies ensures that the actual phase shifts are set optimally for each operating frequency when it is in use.

With this technique, breaking the frequency range from 1235 MHz to 1365 MHz into the twenty sub-bands numbered from 1 to 20 in FIG. 4 enables a phase accuracy of 1.34° rms to be maintained over the entire band. This error together with a phase shifter quantization error of 1.62° rms results in a total error of 2.1° rms. A 100 element phased array antenna using the phase shifter 10 can provide a mean sidelobe level of −50.9 dB rms at $F_L$=1235 MHz, excluding the effects of diffraction sidelobes. The mean sidelobe level rises to −31.7 dB at $F_U$=1365 MHz. With the improved phase accuracy provided by phase shifting system 100, a mean sidelobe level of −48.7 dB rms can be maintained across the entire 1235 MHz to 1365 MHz frequency band.

A common source of phase commands is the beam steering controller (BSC) of a phased array antenna. Such beam steering controllers provide as many separate six-bit phase commands in each cycle as there are separately settable elements in the phased array antenna. As a consequence, internal modification of the beam steering controller to accommodate changes in actual phase with frequency is difficult at best. External modification of the beam steering controller's outputs in accordance with this invention avoids any need to customize the beam steering controller to the phase versus frequency characteristic of a particular phase shifter design.

Figure 5:
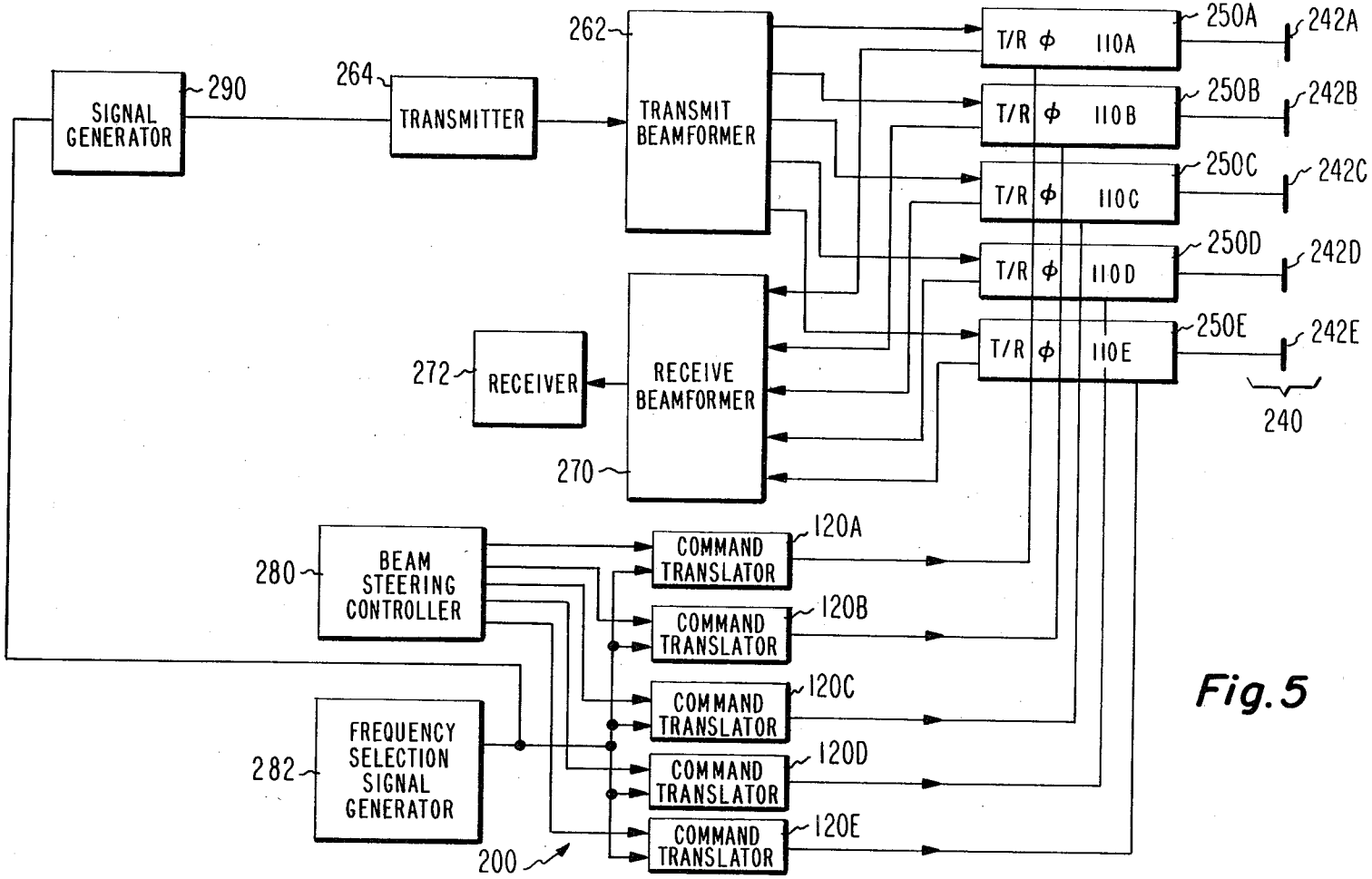
FIG. 5 illustrates a communication or radar system employing the inventive phase shifting system.

A communication or radar system 200 employing a phase shifter system in accordance with the invention is illustrated in FIG. 5. This system employs a phased array antenna 240 of which five individual radiating elements 242A, 242B, 242C, 242D and 242E, are illustrated. Each of these radiating elements is coupled to an associated transmit/receive (T/R) module 250A, 250B, 250C, and so forth. Each T/R module includes a phase shifter 110 like that illustrated in FIG. 3. Each of the phase shifters 110 is connected to its own phase command translator 120A, 120B, 120C etc. The command translators 120 are connected to the outputs of the communication or radar system's beam steering controller 280 and its frequency selection signal generator 282. For transmission, the selected frequency signal is generated in signal generator 290 which provides it to a transmitter 264 which in turn feeds a transmit beamformer 262 whose outputs are connected to the transmit inputs of the T/R modules. The RF signal provided to each of these modules is phase shifted in accordance with the phase control signals applied to the individual phase shifters. These phase shifted signals pass to the individual radiating elements for radiation into the ambient environment where the combined radiation from all of the elements of the antenna provides a steered radiated beam.

When in the receive mode, the received signal at each antenna element 242 is passed to the associated phase shifter 110 where it is phase shifted in accordance with the setting of that phase shifter. These phase shifts determine the receive orientation of the antenna beam. From the phase shifters the signals pass to the receive outputs of the T/R modules. These outputs are connected to the appropriate terminals of a receive beamformer 270. The receive beamformer 270 combines these signals and provides them to a receiver 272 for further processing in accordance with the overall processing scheme of the system in which communication system 200 is incorporated.

One of the primary benefits of the high phase setting accuracy and wide overall operating bandwidth of the phase shifters of FIG. 3 is the ability of the system 200 to provide a phased array beam having the desirable characteristics of a well defined main beam with low sidelobes over a wide bandwidth. The major affect of the increased phase setting accuracy is on the levels of the sidelobes rather than on the shape of the main beam. Low sidelobe characteristics for such a system can have a critical effect on the system's immunity to electronic countermeasures and to its security in avoiding providing an intelligible signal at any location which is not within the main beam portion of the signal.

What is claimed is:

1. In a controllable digital phase shifting system responsive to a phase command signal which specifies a desired phase shift, said system having an operating frequency range and including a digital phase shifter for selectably phase shifting an AC signal propagating therethrough, said digital phase shifter including a plurality of phase shifting elements connected in series, each of said phase shifting elements having first and second states and providing a reference phase shift when in said first state and providing an additional increment of phase shift when in said second state, said phase shifter including means responsive to a digital control signal for setting each of said phase shifting elements in either said first or said second state in accordance with the value of said digital control signal, said increments of phase shift provided by said phase shifting elements changing with frequency over said operating frequency range, the improvement for phase shifting said AC signal by substantially the phase shift specified by said phase command signal at any selected frequency within said operating frequency range despite said phase change with frequency, comprising:

means for providing a frequency selection signal indicative of a selected one of a plurality of frequency sub-bands, each of said frequency sub-bands being within said operating frequency range;

means responsive to said phase command signal and said frequency selection signal for producing said digital control signal with a value which is determined by said selected frequency sub-band and the value of said phase command signal; and means for coupling said digital control signal from said means for producing to said means for setting.

2. The improvement recited in claim 1 wherein at a selected frequency within said operating frequency range each phase shifting element provides a phase shift increment which is substantially one half of the phase shift increment provided by the element providing the next larger phase shift increment.

3. The improvement recited in claim 1 wherein:

said phase command signal and said phase control signal each comprise a plurality of binary bits; and said means for producing produces a digital phase control signal having more binary bits than said phase command signal.

4. The improvement recited in claim 1 wherein said means for producing comprises:

a read only memory;

means for combining said phase command signal and said frequency selection signal to form the address of a register in said read only memory in which the value of said digital control signal for that phase and frequency combination is stored; and means for coupling the output of said means for combining to said read only memory as an address signal.

5. The improvement recited in claim 1 further including a plurality of said phase shifters.

6. The improvement recited in claim 1 wherein said means for producing comprises:

means for storing a plurality of different values of said digital control signal; and means associated with said means for storing and responsive to the values of said phase command signal and said frequency selection signal for causing said means for storing to provide a corresponding one of said stored values at its output as the value of said digital control signal.

7. In a controllable digital phase shifting system having an operating frequency range and including a plurality of digital phase shifters each for selectably phase shifting an AC signal propagating through it, each of said digital phase shifters including a plurality of phase shifting elements connected in series, each of said phase shifting elements having first and second states and providing a reference phase shift when in said first state and providing an additional increment of phase shift when in said second state, each of said phase shifters including means responsive to a digital control signal for setting each of its phase shifting elements in either said first or said second state in accordance with the value of said digital control signal, said increments of phase shift provided by said phase shifting elements changing with frequency over said operating frequency range, said system being responsive to a plurality of phase command signals each of which specifies a commanded phase shift for a different one of said plurality of phase shifters, the improvement for causing each of said phase shifters to phase shift said AC signal propagating therethrough by substantially its commanded phase shift at any selected frequency within said operating frequency range despite said phase change with frequency, comprising:

means for providing a frequency selection signal indicative of a selected one of a plurality of frequency sub-bands, each of said frequency sub-bands being within said operating frequency range;

a plurality of means each responsive to said frequency selection signal and an associated one of said phase command signals for producing a digital control signal with a value which is determined by said selected frequency sub-band and the value of said associated phase command signal, a different one of said means for producing being associated with each of said phase shifters; and means for coupling each of said digital control signals from the one of said means for producing which produces it to said means for setting of the one of said phase shifters which is associated with that means for producing.

8. The improvement recited in claim 7 wherein:

said phase shifting system forms a part of a phased array antenna system; and each of said plurality of phase shifters is associated with a different radiation element of said phased array antenna system.

9. The improvement recited in claim 8 wherein:

said antenna system includes a transmit/receive module associated with each antenna radiation element; and each phase shifter is incorporated in a different transmit/receive module.

10. The improvement recited in claim 8 wherein:

said phased array antenna system includes a beam steering controller for providing a plurality of separate, individual, phase command signals, one associated with each of said phase shifters; and means for coupling each of said phase command signals from said beam steering controller to said means for producing which is associated with the same phase shifter as said phase command.

11. In a controllable digital phase shifting system responsive to a phase command signal which specifies a commanded phase shift, said system having an operating frequency range and including a digital phase shifter for selectably phase shifting an AC signal propagating therethrough, said digital phase shifter including a plurality of phase shifting elements connected in series, each of said phase shifting elements having first and second states and providing a reference phase shift when in said first state and providing an additional increment of phase shift when in said second state, said phase shifter including means responsive to a digital control signal for setting each of said phase shifting elements in either said first or said second state in accordance with the value of said digital control signal, said increments of phase shift provided by said phase shifting elements changing with frequency over said operating frequency range, the improvement for phase shifting said AC signal by substantially said commanded phase shift at any selected frequency within said operating frequency range despite said phase change with frequency wherein:

an n-bit phase command signal specifies the commanded phase shift;

said phase shifter has at least $(n+1)$ individually settable phase shifting elements; and said system further comprises:

means for providing a frequency selection signal indicative of a selected one of a plurality of frequency sub-bands, each of said frequency sub-bands being within said operating frequency range;

means responsive to said n-bit phase command signal and said frequency selection signal for producing said digital control signal with at least $n+1$ bits and having a value which is determined by said selected frequency sub-band and the value of said n-bit phase command signal; and means for coupling said digital control signal from said means for producing to said means for setting.

12. The improvement recited in claim 11 wherein:

$n \doteq 6$;

said phase shifter has seven individually settable phase shifting elements; and said means for producing receives a six-bit phase command signal and provides a seven-bit digital control signal.

13. A digital phase shifter for use over an operating frequency range comprising:

means responsive to a frequency selection signal and a phase command signal, for producing a digital control signal with a value which is determined by the value of said frequency selection signal and the value of said phase command signal, said frequency selection signal indicating a selected frequency sub-band which is within said operating frequency range, and said phase command signal specifying a desired phase shift;

a plurality of phase shifting elements connected in series in the propagation path of an AC signal to be phase shifted, each of said phase shifting elements having first and second states and providing a reference phase shift when in said first state and providing an additional increment of phase shift when in said second state, said increments of phase shift changing with frequency;

means responsive to said digital control signal for setting each of said phase shifting elements in either said first or said second state in accordance with the value of said digital control signal; and means for coupling said digital control signal from said means for producing to said means for setting.

* * * * *